US009688065B2

(12) United States Patent
Takeuchi et al.

(10) Patent No.: US 9,688,065 B2
(45) Date of Patent: Jun. 27, 2017

(54) TRANSFER FILM, TRANSFER METHOD AND INKJET RECORDING APPARATUS

(71) Applicant: MIMAKI ENGINEERING CO., LTD., Nagano (JP)

(72) Inventors: Kazuyuki Takeuchi, Nagano (JP); Katsumi Nakayashiki, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/382,320

(22) PCT Filed: Mar. 5, 2013

(86) PCT No.: PCT/JP2013/056033
§ 371 (c)(1),
(2) Date: Sep. 1, 2014

(87) PCT Pub. No.: WO2013/141019
PCT Pub. Date: Sep. 26, 2013

(65) Prior Publication Data

US 2015/0246528 A1 Sep. 3, 2015

(30) Foreign Application Priority Data

Mar. 19, 2012 (JP) ..... 2012-062720

(51) Int. Cl.
*B41J 2/005* (2006.01)
*B44C 1/17* (2006.01)
(Continued)

(52) U.S. Cl.
CPC ..... *B41J 2/0057* (2013.01); *B41J 2/01* (2013.01); *B41J 31/00* (2013.01); *B41M 5/035* (2013.01);
(Continued)

(58) Field of Classification Search
CPC ..... B41M 5/025; B41M 5/0256; B41M 5/035
See application file for complete search history.

(56) References Cited

U.S. PATENT DOCUMENTS 4,021,591 A * 5/1977 DeVries ..... B44C 1/1716 101/470
5,741,387 A * 4/1998 Coleman ..... 156/240
(Continued)

FOREIGN PATENT DOCUMENTS

CN 101421114 4/2009
EP 1816002 8/2007
(Continued)

OTHER PUBLICATIONS

"International Search Report (Form PCT/ISA/210)", mailed on May 21, 2013, pp. 1-4, in which two of the listed references (JP02-154083 and JP2003-063198) were cited.
(Continued)

*Primary Examiner* — Stephen Meier
*Assistant Examiner* — John P Zimmermann
(74) *Attorney, Agent, or Firm* — Jianq Chyun IP Office

(57) ABSTRACT

The present invention addresses the problem of forming, using a sublimation ink, an image that is free of outline blurring on a transfer medium even when the thickness of an ink fixation layer is increased. In order to solve this problem, a transfer film 10 is provided with a base material film 11, a transfer binder layer 12, a sublimation ink layer 13, and a mask layer 14 which is provided in a region where sublimation ink is not transferred to media 100, the transfer binder layer 12 being configured from a material which is permeated by sublimation of the sublimation ink.

9 Claims, 2 Drawing Sheets

(51) Int. Cl.

| | |
|---|---|
| ***B41M 5/035*** | (2006.01) |
| ***B41J 31/00*** | (2006.01) |
| ***D06P 5/28*** | (2006.01) |
| *B41J 2/01* | (2006.01) |

(52) U.S. Cl.
CPC ..... *B44C 1/17* (2013.01); *D06P 5/004* (2013.01); *B41J 2002/012* (2013.01); *B41M 2205/14* (2013.01)

(56) References Cited

U.S. PATENT DOCUMENTS

| | | | | |
|---|---|---|---|---|
| 6,001,771 | A * | 12/1999 | Nakano | B41M 5/38257 428/32.39 |
| 6,540,345 | B1 | 4/2003 | Wagner et al. | |
| 6,824,639 | B1 * | 11/2004 | Hill et al. | 156/230 |
| 6,909,444 | B2 * | 6/2005 | Ishida | B41J 2/325 347/187 |
| 2002/0105570 | A1 | 8/2002 | Minowa | |
| 2004/0041894 | A1 * | 3/2004 | Martin et al. | 347/103 |
| 2004/0045931 | A1 * | 3/2004 | Hill et al. | 216/54 |
| 2005/0148469 | A1 * | 7/2005 | Yukawa | B41M 5/42 503/227 |
| 2005/0266204 | A1 * | 12/2005 | Abrams | 428/90 |
| 2005/0268407 | A1 * | 12/2005 | Abrams | 8/539 |
| 2006/0109327 | A1 * | 5/2006 | Diamond et al. | 347/102 |
| 2007/0022548 | A1 * | 2/2007 | Abrams | 8/471 |
| 2007/0181253 | A1 * | 8/2007 | Xu et al. | 156/344 |
| 2008/0160229 | A1 * | 7/2008 | Oz | 428/32.6 |
| 2011/0025745 | A1 | 2/2011 | Izawa et al. | |
| 2012/0162332 | A1 * | 6/2012 | McKean et al. | 347/100 |
| 2013/0340930 | A1 * | 12/2013 | Chevallier | B44C 1/1725 156/235 |

FOREIGN PATENT DOCUMENTS

| | | |
|---|---|---|
| JP | 02-154083 | 6/1990 |
| JP | 2002-210943 | 7/2002 |
| JP | 2003-063198 | 3/2003 |
| JP | 2009-526664 | 7/2009 |
| JP | 2011-068033 | 4/2011 |

OTHER PUBLICATIONS

"The Extended European Search Report of European Counterpart Application", issued on Nov. 9, 2015, pp. 1-9.
"Office Action of Japan Counterpart Application", issued on Dec. 8, 2015, with English translation thereof, pp. 1-7.
"Office Action of China Counterpart Application", issued on Dec. 11, 2015, pp. 1-16, with English translation thereof.
"Office Action of Japan Counterpart Application", issued on Apr. 12, 2016, p. 1-8, with English translation thereof.
"Office Action of Japan Counterpart Application" with English translation thereof, issued on Sep. 13, 2017, p. 1-7.

* cited by examiner

TRANSFER FILM, TRANSFER METHOD AND INKJET RECORDING APPARATUS

CROSS-REFERENCE TO RELATED APPLICATION

This application is a 371 application of an international PCT application serial no. PCT/JP2013/056033, filed on Mar. 5, 2013, which claims the priority benefit of Japan application no. 2012-062720, filed on Mar. 19, 2012. The entirety of each of the above-mentioned patent applications is hereby incorporated by reference herein and made a part of this specification.

TECHNICAL FIELD

The present invention relates to a transfer film, a transfer method and an inkjet recording apparatus for transferring an image to a transferred medium from a base member.

BACKGROUND ART

In Patent Literature 1, a method is described in which a printing medium is heated and sublimation dye ink is diffused and developed color on a surface of a medium main body to form an image.

CITATION LIST

Patent Literature

[Patent Literature 1] Japanese Patent Laid-Open No. 2002-210943 (published on Jul. 31, 2002)

SUMMARY OF THE INVENTION

Technical Problem

The sublimation dye which is impregnated in an ink image receiving sheet is also diffused in a plane direction when an ink fixing layer is thick and the contour of an image becomes blurry. It is conceivable that diffusion in a plane direction of the sublimation dye is prevented by reducing the thickness of the ink fixing layer. However, when an ink fixing layer is thin, in a case that a medium which is an object to be formed with an image is coarse material like a fabric, the ink fixing layer cannot be formed so as to straddle between fibers. Therefore, the image quality is deteriorated.

In view of the problem described above, an objective of the present invention is to form an image whose contour does not become blurry on a transferred medium even when a sublimation ink is used and an ink fixing layer is thick.

Solution to Problem

A transfer film in accordance with the present invention includes a base member, a transfer binder layer provided on the base member, a sublimation ink layer which is provided on the transfer binder layer, the sublimation ink layer being a layer which forms an image for being transferred to a transferred medium by using a sublimation ink, and a mask layer which is provided in a preset region where the sublimation ink is not transferred to the transferred medium. The transfer binder layer is structured of material into which the sublimation ink is permeated through sublimation.

The sublimation ink is permeated and diffused into the transfer binder layer and thereby the ink fixing layer is formed. In a case that the ink fixing layer is to be transferred to a transferred medium, even when the sublimation ink is diffused in a plane direction of the ink fixing layer, transfer of the sublimation ink which is blurred to the region is prevented by the mask layer. In other words, only the sublimation ink of the ink fixing layer in only a desired region is transferred on the transferred medium by the mask layer and thus the contour of an image is prevented from becoming blurry. Therefore, even when a sublimation ink is used and an ink fixing layer is set to be thick, an image whose contour does not become blurry can be formed on a transferred medium.

Further, when the background of an image has been also printed solidly without providing the mask layer and then transferred to a fabric, a region transferred to the fabric becomes large and a texture of the fabric is impaired. For example, even if a fabric is attempted to expand and contract, the region where an image has been printed is large and expansion/contraction degree of the region is different from the fabric and thus it is hard to be expanded and contracted. This problem is further noticeable when the ink fixing layer becomes thick. However, since the present invention is capable of preventing this problem, a texture of the fabric is not impaired. Further, since a background which is not originally needed is not transferred, a satisfactory color like a direct printing of an image on a fabric can be obtained. Therefore, a texture of the fabric is not impaired and a transferred medium having a satisfactory color can be obtained.

In the transfer film in accordance with the present invention, it is preferable that the mask layer is provided on the transfer binder layer in a region where the sublimation ink layer is not provided.

The mask layer is also formed while forming the sublimation ink layer on the transfer binder layer by inkjet and thus the transfer film can be produced easily. Further, an amount of the sublimation ink can be reduced in comparison with a case that the sublimation ink layer is solidly formed on the transfer binder layer. Further, in comparison with a case that the mask layer is formed on the sublimation ink layer, the ink concentration of the sublimation ink layer in a region where an image is formed can be increased. This is because that, when the mask layer is adjacently formed to the sublimation ink layer, the mask layer prevents diffusing and blurring of ink from the sublimation ink layer in a plane direction.

In the transfer film in accordance with the present invention, it is preferable that adhesive strength between the transfer binder layer and the mask layer is stronger than adhesive strength between the transferred medium and the mask layer.

When the transfer film is to be peeled after the transfer film is attached by pressure to the transferred medium, the mask layer can be effectively peeled together with the transfer film while the image is left on the transferred medium.

In the transfer film in accordance with the present invention, it is preferable that the mask layer is formed of ink including ultraviolet curing type resin.

When ultraviolet rays are irradiated to cure the mask layer, in a case that the transfer film is to be peeled after the transfer film is attached by pressure to the transferred medium, the mask layer is easily peeled from the transferred medium.

A transfer method in accordance with the present invention is a transfer method for transferring an image to a transferred medium, the transfer method including a transfer binder layer forming process in which a transfer binder layer is provided on a base member, a sublimation ink layer forming process in which a sublimation ink layer is provided on the transfer binder layer, the sublimation ink layer being a layer which forms an image to be transferred to a transferred medium by using a sublimation ink, a mask layer forming process in which a mask layer is provided in a region where the sublimation ink is not transferred on the transferred medium, and a transfer process in which the sublimation ink layer and the mask layer are attached by pressure to the transferred medium to transfer the image. The transfer binder layer is structured of material into which the sublimation ink is permeated by applying heat.

The sublimation ink is permeated and diffused into the transfer binder layer and thereby the ink fixing layer is formed. In a case that the ink fixing layer is to be transferred to a transferred medium, even when the sublimation ink is diffused in a plane direction of the ink fixing layer, transfer of the sublimation ink which is blurred to the region is prevented by the mask layer. In other words, only the sublimation ink of the ink fixing layer in only a desired region is transferred on the transferred medium by the mask layer and thus the contour of an image is prevented from becoming blurry. Therefore, even when a sublimation ink is used and an ink fixing layer is set to be thick, an image whose contour does not become blurry can be formed on a transferred medium.

It is preferable that the transfer method in accordance with the present invention includes a mask layer curing process in which the mask layer is cured so that adhesive strength between the transfer binder layer and the mask layer is stronger than adhesive strength between the transferred medium and the mask layer.

When the transfer film is to be peeled after the transfer film is attached by pressure to the transferred medium, the mask layer can be effectively peeled from the transferred medium while the image is left on the transferred medium.

In the transfer method in accordance with the present invention, it is preferable that the mask layer is formed of ink including ultraviolet curing type resin and, in the sublimation ink layer forming process and the mask layer forming process, the mask layer is formed while forming the sublimation ink layer by an inkjet recording apparatus.

The sublimation ink layer and the mask layer are simultaneously produced by one inkjet recording apparatus. Therefore, a transfer film in accordance with the present invention can be easily produced in a further short period of time.

In the transfer method in accordance with the present invention, after the sublimation ink layer and the mask layer are attached by pressure to the transferred medium in the transfer process, the sublimation ink layer and the transfer binder layer are heated to permeate the sublimation ink into the transfer binder layer.

The sublimation ink is permeated and diffused into the transfer binder layer located just above the sublimation ink and the ink fixing layer which is a transfer binder layer including the sublimation ink is formed and thereby a transfer image is formed.

An inkjet recording apparatus in accordance with the present invention includes a first head which ejects a sublimation ink for forming an image to provide a sublimation ink layer, a second head which ejects mask material for providing a mask layer in a preset region where the sublimation ink is not transferred to a transferred medium, a first head control means which controls the first head so as to eject the sublimation ink based on image information representing the image, and a second head control means which controls the second head so as to eject the mask material to the preset region.

According to this structure, the transfer film in accordance with the present invention can be produced easily.

Effects of the Invention

According to the present invention, even when a sublimation ink is used and an ink fixing layer is set to be thick, an image whose contour does not become blurry can be formed on a transferred medium.

DESCRIPTION OF EMBODIMENTS

<Transfer Film and Transfer Method>

Figure 1A:
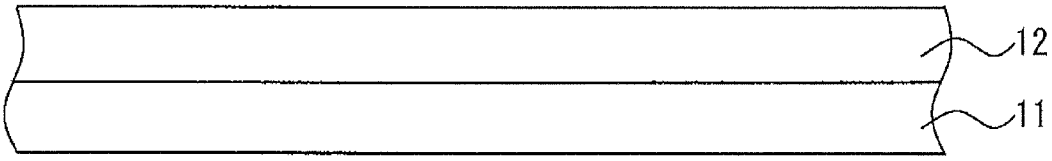
FIGS. 1A through 1D are views showing a procedure of an embodiment of a transfer method in accordance with the present invention.

An embodiment of the present invention will be described in detail below. First, an embodiment of a transfer film and a transfer method in accordance with the present invention will be described below with reference to FIGS. 1A through 1D. FIGS. 1A through 1D are views showing a procedure of an embodiment of a transfer method in accordance with the present invention.

In this embodiment, first, a transfer film 10 is produced and then, a sublimation ink forming an image in the transfer film 10 is transferred to a medium (transferred medium) 100 to print the image on the medium 100.

As a specific example of the medium 100, for example, a fabric is preferably used. In other words, a transfer film in accordance with the present invention is further suitable for transferring to a fabric. In a case of a coarse medium like a fabric, it is preferable that an ink fixing layer is thick. This is because that deterioration of an image quality can be prevented by forming an ink fixing layer so as to straddle between fibers. On the other hand, a conventional technique has a problem that, when an ink fixing layer is set to be thick, a sublimation ink is diffused in a plane direction and the contour becomes blurry. However, the present invention is capable of solving the problem. For example, in this embodiment, the sublimation ink is diffused through permeation to a transfer binder layer 12 described below to form an ink fixing layer. In a case that the ink fixing layer is to be transferred to a medium 100, even when the sublimation ink is diffused in a plane direction of the ink fixing layer, transferring of a blurred sublimation ink on the medium 100 is prevented by a mask layer 14. In other words, only the sublimation ink of the ink fixing layer in only a desired region is transferred on the medium 100 by the mask layer 14 and thus the contour of an image can be prevented from becoming blurry. Therefore, even when a sublimation ink is used and an ink fixing layer is set to be thick, an image whose contour does not become blurry can be formed on a transferred medium.

Further, a texture of a fabric is not impaired and a transferred medium having a good color can be obtained. In other words, a sublimation ink layer 13 described below is prevented from being transferred on the medium 100 solidly by the mask layer 14. If the background of an image has been also printed solidly without providing the mask layer 14 and then transferred to a fabric, a region transferred to the fabric becomes large and a texture of the fabric is impaired. For example, even if a fabric is attempted to be expanded and contracted, the region where an image is printed is large and expansion/contraction degree of the region is different from the fabric and thus it is hard to be expanded and contracted. However, since the present invention is capable of preventing this problem, a texture of the fabric is not impaired. Further, since a background which is not originally needed is not transferred, a satisfactory color like a direct printing of an image on a fabric can be obtained.

First, as shown in FIG. 1A, a transfer binder layer 12 is provided on a base film (base member) 11 (transfer binder layer forming process). It is further preferable that a coating agent for preventing exudation of ink from an ink fixing layer 15 described below is applied to a surface of the base film 11 beforehand. Since the coating agent covers the surface of the ink fixing layer 15 after having been transferred, exudation of the ink to the surface of a printed matter can be prevented.

The transfer binder layer 12 is a layer for coupling the base film 11 to the sublimation ink layer 13 and the mask layer 14. The transfer binder layer 12 is structured of material into which the sublimation ink having been sublimated is permeated and diffused by sublimating the sublimation ink of the sublimation ink layer 13 described below. For example, the transfer binder layer provided in the transfer film in accordance with the present invention may be structured of material such as urethane; rubber such as NBR, SBR or IP (isoprene), or the like. A method for sublimating the sublimation ink may be appropriately selected dependent on a type of the sublimation ink and, for example, the sublimation ink layer 13 may be heated or pressurized. In this embodiment, a case that a sublimation ink is sublimated by being heated will be described. Since a sublimation ink is permeated to form an image after having been transferred, the transfer binder layer 12 may be referred to as a layer for giving thickness to an image after transferred.

A method for providing the transfer binder layer 12 is not limited specifically and, for example, material for the transfer binder layer 12 may be applied on the base film 11 by a conventionally known method.

Figure 1B:
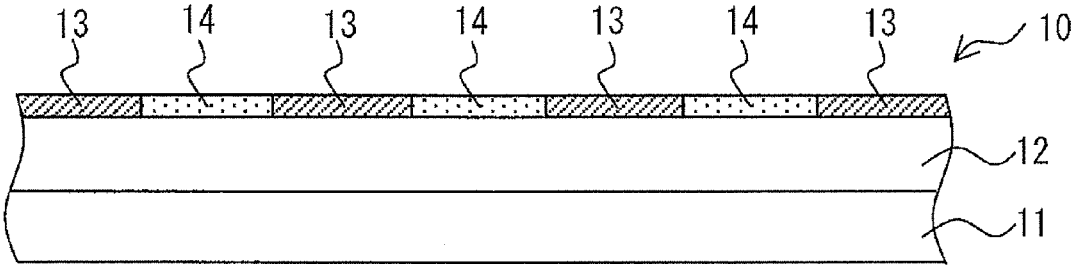

Next, as shown in FIG. 1B, a sublimation ink layer 13 and a mask layer 14 are provided (sublimation ink layer forming process and mask layer forming process).

The sublimation ink layer 13 is a layer including a sublimation ink and forms an image to be transferred to a medium 100. The sublimation ink is ink having sublimability and is sublimated by supplying heat. In this embodiment, when sublimated, the sublimation ink is permeated and diffused into the transfer binder layer 12. In this manner, the transfer binder layer 12 is changed to an ink fixing layer 15. The ink fixing layer 15 is a layer for fixing ink on a medium 100.

The mask layer 14 is a layer provided in a predetermined region where a sublimation ink is not transferred on a medium 100. In a region where the mask layer 14 is provided, a sublimation ink (more specifically, sublimation ink diffusion layer 15 described below) is not transferred on the medium 100. The mask material structuring the mask layer 14 may sufficiently utilize material which prevents transferring of a sublimation ink and, for example, ink including ultraviolet curing type resin may be utilized.

Further, as shown in FIG. 1B, the mask layer 14 is provided on the transfer binder layer 12 in a region where the sublimation ink layer 13 is not provided. In other words, only a required image is printed by a sublimation ink and the background and the like are not printed and the mask layer 14 is provided in a surrounding area of the image and a space in a region of the image formed by the sublimation ink. As described above, since both of the sublimation ink layer 13 and the mask layer 14 are provided on the transfer binder layer 12, the transfer film 10 is easily produced. In other words, when both of a sublimation ink and mask material are ejected by inkjet, the mask layer 14 can be provided while providing the sublimation ink layer 13.

In other words, a method for providing the sublimation ink layer 13 and the mask layer 14 is not limited specifically but it is further preferable to provide them through inkjet by an inkjet recording apparatus. When an inkjet recording apparatus is provided with respective heads for ejecting a sublimation ink and mask material, the mask layer 14 can be formed while forming the sublimation ink layer 13 in the same pass. In this manner, the transfer film 10 can be easily produced in a further short period of time.

Next, ultraviolet rays are irradiated to cure the mask layer 14 (mask layer curing process). As a result, the adhesive strength between the transfer binder layer 12 and the mask layer 14 becomes stronger than the adhesive strength between the medium 100 and the mask layer 14. This is because that, when the transfer film 10 is to be peeled after the transfer film 10 is attached by pressure, the mask layer 14 is easily peeled from the medium 100. In other words, since the mask layer 14 is bonded to the transfer binder layer 12 with a higher strength than to the medium 100, the mask layer 14 is easily peeled from the medium 100.

In this manner, the transfer film 10 as an embodiment of a transfer film in accordance with the present invention is produced.

Figure 1C:
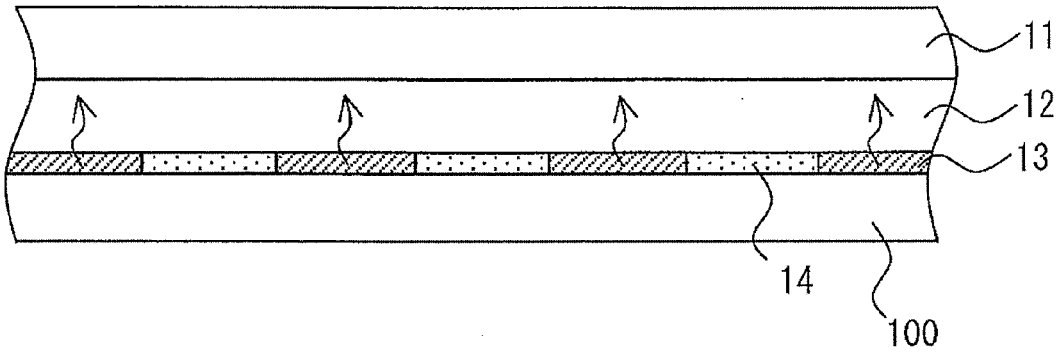
Figure 1D:
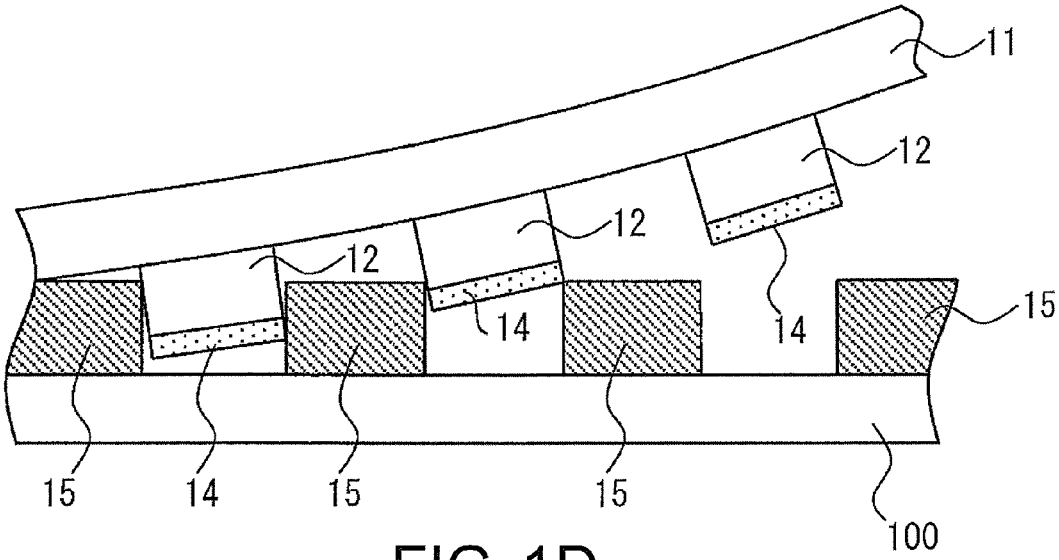

Next, as shown in FIG. 1C, the transfer film 10 is attached by pressure to the medium 100 to transfer an image (transfer process). In this process, after the sublimation ink layer 13 and the mask layer 14 are attached by pressure to the medium 100, the sublimation ink layer 13 and the transfer binder layer 12 are heated to permeate the sublimation ink into the transfer binder layer 12. As a result, the sublimation ink is diffused in the transfer binder layer 12 just above the sublimation ink layer 13 and the ink fixing layer 15 shown in FIG. 1D is formed. The sublimation ink may be blurred in a plane direction of the ink fixing layer 15 but the sublimation ink in the blurred region is not transferred on the medium 100 by the mask layer 14. Therefore, the contour of an image formed on the medium 100 does not become blurry. The temperature of heating may be appropriately set depending on materials structuring the sublimation ink and the transfer binder layer 12.

The heating temperature for the transfer binder layer 12 and the sublimation ink layer 13 is not limited as long as the sublimation ink can be sublimated.

Further, the mask layer 14 is cured beforehand in the mask layer curing process and adhesive strength to the medium 100 is weaker than adhesive strength to the transfer binder layer 12. Therefore, the sublimation ink layer 13, in other words, the ink fixing layer 15 after having been heated is bonded to the medium 100, but the mask layer 14 is easily separated by peeling as described below.

Next, as shown in FIG. 1D, the transfer film 10 is peeled from the medium 100. In this case, the ink fixing layer 15 is left on the medium 100 to form an image. On the other hand, the adhesive strength between the mask layer 14 and the transfer binder layer 12 is stronger than the adhesive strength between the mask layer 14 and the medium 100 and thus, the mask layer 14 is not left on the medium 100 and is peeled together with the base film 11 and the transfer binder layer 12.

As described above, the image is formed on the medium 100.

Modified Embodiment

Figure 2:
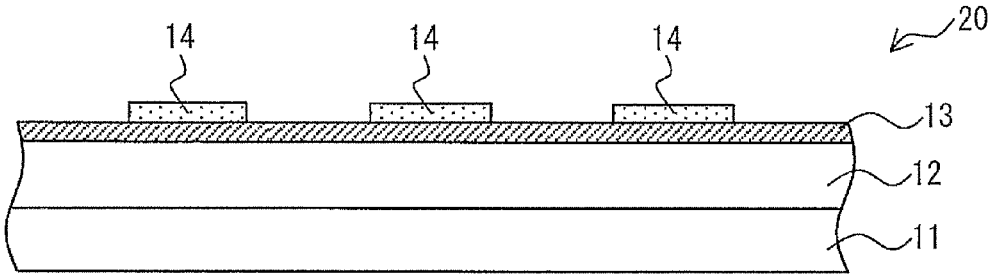
FIG. 2 is a view showing a structure of a modified embodiment of a transfer film in accordance with the present invention.

Next, a modified embodiment of a transfer film in accordance with the present invention which is different from the transfer film 10 will be described below with reference to FIG. 2.

A transfer film 20 includes a base film 11, a transfer binder layer 12, a sublimation ink layer 13 and a mask layer 14.

The transfer film 10 and the transfer film 20 are different from each other in a region where the sublimation ink layer 13 and the mask layer 14 are formed. In other words, in the transfer film 10, the mask layer 14 is formed in a gap space and on an outer side of the sublimation ink layer 13 which structures an image. On the other hand, in the transfer film 20, the sublimation ink layer 13 is solidly formed on the transfer binder layer 12 and the mask layer 14 is formed on the sublimation ink layer 13 in a region where a sublimation ink is not transferred to the medium 100, so that the sublimation ink is not transferred.

As a result, even when a sublimation ink is diffused, transfer of the sublimation ink is prevented by the mask layer 14 except a region where the transfer is desired and thus, similarly to the transfer film 10, an image without blurring of its contour can be formed on the medium 100.

<Inkjet Recording Apparatus>

Figure 3:
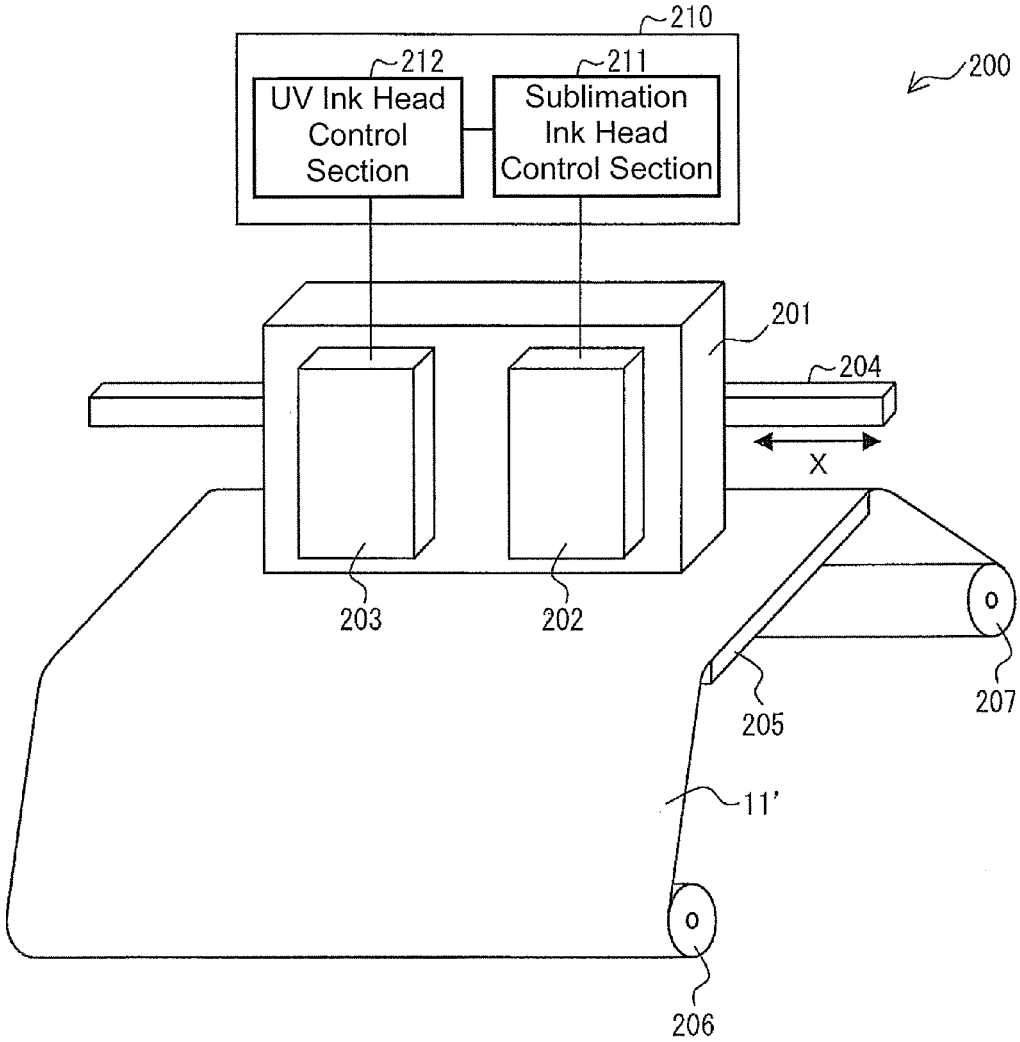
FIG. 3 is a view schematically showing a structure of an embodiment of an inkjet recording apparatus in accordance with the present invention.

Next, an embodiment of an inkjet recording apparatus in accordance with the present invention will be described below with reference to FIG. 3. FIG. 3 is a view schematically showing a structure of an inkjet recording apparatus 200 which is an embodiment of an inkjet recording apparatus in accordance with the present invention.

The inkjet recording apparatus 200 is an apparatus in which a sublimation ink and mask material are applied to a transfer film sheet 11' by inkjet to form a transfer film in accordance with the present invention. The transfer film sheet 11' is structured of the base film 11 and the transfer binder layer 12 described above and is mounted so that a sublimation ink and mask material are landed on the transfer binder layer 12.

The inkjet recording apparatus 200 includes a carriage 201, a guide mechanism 204, a platen 205, a control section 210, a drive roller 206 and a driven roller 207.

The carriage 201 includes a sublimation ink head (first head) 202 and a UV ink head (second head) 203.

A moving direction of the carriage 201 is determined by the guide mechanism 204 and is reciprocatedly moved in the arrow "X" direction. In this manner, the carriage 201 scans on the transfer film sheet 11'.

The sublimation ink head 202 is a head from which a sublimation ink for forming an image is ejected to provide a sublimation ink layer on the transfer film sheet 11'. In a case that the carriage 201 is scanned on the transfer film sheet 11', a sublimation ink is ejected from the sublimation ink head 202 based on predetermined image information. Ejection of ink from the sublimation ink head 202 is controlled by a sublimation ink head control section (first head control means) 211 described below.

The UV ink head 203 is a head from which a UV ink that is mask material is ejected so as to provide the mask layer in a preset region of the medium where the sublimation ink is not transferred. When the carriage 201 is scanned on the transfer film sheet 11', a UV ink is ejected from the UV ink head 203 based on predetermined image information. Ejection of ink from the UV ink head 203 is controlled by a UV ink head control section (second head control means) 212 described below. The "UV ink" is ink including ultraviolet curing type resin. The inkjet recording apparatus 200 may include an ultraviolet irradiation means for curing the UV ink.

As described above, two types of head, i.e., the sublimation ink head 202 which is a head for a sublimation ink and the UV ink head 203 which is a head for mask material are provided and thus, in a transfer film in accordance with the present invention, an embodiment in which the mask layer is provided on the transfer binder layer in a region where a sublimation ink layer is not provided is preferably produced.

In other words, the mask layer can be formed while forming a sublimation ink layer on the transfer binder layer by ejecting a UV ink while ejecting a sublimation ink. A film in accordance with the present invention can be produced in an extremely short period of time in comparison with a case that the mask layer is formed after a sublimation ink layer has been formed.

The guide mechanism 204 is a mechanism for determining a moving direction of the carriage 201. The carriage 201 is attached to the guide mechanism 204 so as to be capable of moving in the arrow "X" direction which is a length direction of the guide mechanism 204.

The platen 205 is a base for placing a transfer film sheet 11' which is an object to be printed. A sublimation ink and a UV ink are ejected on the transfer film sheet 11' on the platen 205.

The drive roller 206 is operated so as to move the transfer film sheet 11'. Further, the transfer film sheet 11' wound around the driven roller 207 described below is wound by the drive roller 206 and thereby the transfer film sheet 11' is moved.

The driven roller 207 assists conveyance of the transfer film sheet 11' by the drive roller 206. The transfer film sheet 11' is wound around the driven roller 207 and the transfer film sheet 11' is supplied toward the carriage 201 through rotation of the driven roller 207.

The control section 210 controls an operation of the inkjet recording apparatus 200. The control section 210 includes the sublimation ink head control section 211 and the UV ink head control section 212.

The sublimation ink head control section 211 controls the sublimation ink head 202 so as to eject a sublimation ink based on image information representing an image to be formed on a transfer film sheet 11'. Image information may be, for example, obtained through input by a user or the like.

The UV ink head control section 212 controls the UV ink head 203 to eject UV ink, so as to provide a mask layer in a region where a sublimation ink is not transferred to the media.

A specific control method is not limited specifically. For example, it may be structured that a region where a sublimation ink is not printed is calculated based on information representing an image to be formed on the transfer film sheet 11' to prepare information representing a region for ejecting a UV ink and, based on the information, the UV ink head 203 is controlled so as to eject a UV ink. Further, it may be structured that information representing a region where a UV ink is to be ejected is directly inputted by a user or the like and, based on the information, the UV ink head 203 is controlled to eject a UV ink.

The present invention is not limited to the above-mentioned embodiments and various changes and modifications will be included in a scope described in claims and embodiments obtained by appropriately combining technical means respectively disclosed in different embodiments are also included in a technical scope of the present invention.

<Additional Description>

As described above, the transfer film 10 includes the base film 11, the transfer binder layer 12 provided on the base film 11, the sublimation ink layer 13 which is provided on the transfer binder layer 12 and is a layer which forms an image by a sublimation ink for being transferred to a medium 100, and the mask layer 14 which is provided in a preset region where the sublimation ink is not transferred in the medium 100, and the transfer binder layer 12 is structured of material into which the sublimation ink is permeated through sublimation.

The ink fixing layer 15 is formed by permeating and diffusing of the sublimation ink into the transfer binder layer 12. In a case that the ink fixing layer 15 is to be transferred to the medium 100, even when the sublimation ink is diffused in a plane direction of the ink fixing layer 15, the transfer of the sublimation ink which is blurred in the region is prevented by the mask layer 14. In other words, only the sublimation ink of the ink fixing layer only in the desired region is transferred on the medium 100 by the mask layer 14 and thus the contour of the image is prevented from becoming blurry. Therefore, even when a sublimation ink is used and the ink fixing layer 15 is set to be thick, an image whose contour does not become blurry is formed on a transferred medium.

Further, if the background of an image has been printed solidly without providing the mask layer 14 and then transferred to a fabric, a region transferred to the fabric becomes large and a texture of the fabric is impaired. For example, even if a fabric is attempted to be expanded and contracted, the region where an image is printed is large and expansion/contraction degree of the region is different from the fabric and thus it is hard to be expanded and contracted. This problem is further noticeable when the ink fixing layer 15 becomes thick. However, since the present embodiment is capable of preventing this problem, a texture of the fabric is not impaired. Further, since a background which is not originally needed is not transferred, a satisfactory color like a direct printing of an image on a fabric can be obtained. Therefore, a texture of the fabric is not impaired and a transferred medium having a satisfactory color can be obtained.

In the transfer film 10, the mask layer 14 is provided on the transfer binder layer 12 in a region where the sublimation ink layer 13 is not provided. Further, an amount of the sublimation ink can be reduced in comparison with a case that the sublimation ink layer 13 is solidly formed on the transfer binder layer 12. Further, in comparison with a case that the mask layer 14 is formed on the sublimation ink layer 13, the ink concentration of the sublimation ink layer 13 in a region where an image is formed can be increased. This is because that, when the mask layer 14 is adjacently formed to the sublimation ink layer 13, the mask layer 14 prevents diffusing and blurring of ink from the sublimation ink layer 13 in a plane direction.

The mask layer 14 is capable of being formed while forming the sublimation ink layer 13 on the transfer binder layer 12 by inkjet and thus the transfer film can be produced easily.

In the transfer film 10, an adhesive strength between the transfer binder layer 12 and the mask layer 14 is stronger than an adhesive strength between the medium 100 and the mask layer 14.

When the transfer film 10 is to be peeled after the transfer film 10 is attached by pressure to the medium 100, the mask layer 14 can be effectively peeled together with the transfer film 10 while the image is left on the medium 100.

In the transfer film 10, the mask layer 14 is formed of ink including ultraviolet curing type resin.

When ultraviolet rays are irradiated to cure the mask layer 14, in a case that the transfer film 10 is to be peeled after the transfer film 10 is attached by pressure to the medium 100, the mask layer 14 is easily peeled from the medium 100.

An embodiment of a transfer method in accordance with the present invention includes a transfer binder layer forming process in which a transfer binder layer 12 is provided on the base film 11, a sublimation ink layer forming process in which a sublimation ink layer 13 that is a layer of an image is formed on the transfer binder layer 12 by using a sublimation ink, a mask layer forming process in which a mask layer 14 is provided in a region where the sublimation ink is not transferred on the medium 100, and a transfer process in which the sublimation ink layer 13 and the mask layer 14 are attached by pressure to the medium 100 and thereby the image is transferred, and the transfer binder layer 12 is structured of material into which the sublimation ink is permeated by applying of heat.

The ink fixing layer 15 is formed by permeating and diffusing of the sublimation ink into the transfer binder layer 12. In a case that the ink fixing layer 15 is to be transferred to the medium 100, even when the sublimation ink is diffused in a plane direction of the ink fixing layer 15, the sublimation ink which is blurred in the region is prevented from being transferred to the medium 100 by the mask layer 14. In other words, only the sublimation ink of the ink fixing layer only in the desired region is transferred on the medium 100 by the mask layer 14 and thus the contour of the image is prevented from becoming blurry. Therefore, even when a sublimation ink is used and the ink fixing layer 15 is set to be thick, an image whose contour does not become blurry is formed on a transferred medium.

An embodiment of a transfer method in accordance with the present invention includes a mask layer curing process in which the mask layer 14 is cured so that adhesive strength between the transfer binder layer 12 and the mask layer 14 is stronger than adhesive strength between the medium 100 and the mask layer 14.

When the transfer film 10 is to be peeled after the transfer film 10 is attached by pressure to the medium 100, the mask layer 14 can be effectively peeled from the medium 100 while the image is left on the medium 100.

In an embodiment of a transfer method in accordance with the present invention, the mask layer 14 is formed by using ink including ultraviolet curing type resin and, in the sublimation ink layer forming process and the mask layer forming process, the mask layer 14 is formed while forming the sublimation ink layer 13 by the inkjet recording apparatus.

The sublimation ink layer 13 and the mask layer 14 are simultaneously produced by one inkjet recording apparatus.

Therefore, a transfer film in accordance with the present invention can be easily produced in a further short period of time.

In an embodiment of a transfer method in accordance with the present invention, it is further preferable that, in the transfer process, after the sublimation ink layer 13 and the mask layer 14 are attached by pressure to the medium 100, the sublimation ink layer 13 and the transfer binder layer 12 are heated to permeate the sublimation ink into the transfer binder layer.

The sublimation ink is permeated and diffused into the transfer binder layer located just above the sublimation ink and thus the ink fixing layer 15 which is a transfer binder layer including the sublimation ink is formed and thereby a transfer image is formed.

The inkjet recording apparatus 200 includes the sublimation ink head 202 which ejects a sublimation ink for forming an image to provide the sublimation ink layer 13, the UV ink head 203 which ejects mask material for providing the mask layer 14 in a preset region where the sublimation ink is not transferred to a medium 100, the sublimation ink head control section 211 which controls the sublimation ink head 202 so as to eject the sublimation ink based on image information representing an image, and the UV ink head control section 212 which controls the UV ink head 203 so as to eject mask material to the region. According to this structure, the transfer film 10 can be produced easily.

INDUSTRIAL APPLICABILITY

The present invention may be utilized in printing of an image to a fabric such as clothes and a bag.

The invention claimed is:

1. A transfer film, comprising:

a base member which is flexible;

a transfer binder layer that expresses adhesive property by being heated and is provided on the base member;

a sublimation ink layer which is directly provided on the transfer binder layer, the sublimation ink layer being a layer which forms an image for being transferred to a transferred medium which is flexible by using a sublimation ink; and a mask layer which is provided in a preset region where the sublimation ink will not be transferred to the transferred medium, and the transfer binder layer is in a state which the sublimation ink is not permeated through sublimation;

wherein the transfer binder layer is structured of material into which the sublimation ink is permeated through sublimation and thereby an ink fixing layer is formed and adhered to the transferred medium, by applying heat at the time of being transferred to the transferred medium, the sublimation ink is sublimated and permeated into the transfer binder layer for forming the ink fixing layer, and adhesive property of the ink fixing layer is expressed, an adhesive strength between the ink fixing layer and the transferred medium is stronger than an adhesive strength between the transferred medium and the mask layer, an adhesive strength between the transferred medium and the ink fixing layer is stronger than an adhesive strength between the base member and the ink fixing layer.

2. The transfer film according to claim 1, wherein the mask layer is provided on the transfer binder layer in a region where the sublimation ink layer is not provided.

3. The transfer film according to claim 1, wherein the mask layer is formed of an ink including an ultraviolet curing type resin.

4. A transfer method for transferring an image to a transferred medium, comprising:

a transfer binder layer forming process, in which a transfer binder layer is provided on a base member;

a sublimation ink layer forming process, in which a sublimation ink layer is directly provided on the transfer binder layer, the sublimation ink layer being a layer which forms an image to be transferred to a transferred medium by using a sublimation ink;

a mask layer forming process, in which a mask layer is provided in a region where the sublimation ink is not transferred on the transferred medium; and a transfer process, in which the sublimation ink layer and the mask layer are attached by pressure to the transferred medium to transfer the image, wherein the transfer binder layer is structured of material into which the sublimation ink is sublimated and permeated by applying heat and thereby an ink fixing layer is formed and adhered to the transferred medium, in the transfer process, after the sublimation ink layer and the mask layer are attached by pressure to the transferred medium, the sublimation ink layer and the transfer binder layer are heated to a temperature higher than a sublimation temperature of the sublimation ink, and the sublimation ink is sublimated and permeated into the transfer binder layer, where the sublimation ink is not sublimated and permeated prior to the transfer process, so as to form the ink fixing layer and the ink fixing layer is adhered to the transferred medium, the base member is peeled from the ink fixing layer, and only the ink fixing layer, which is permeated with the sublimation ink excepting a region where the mask layer is formed, is transferred to transferred medium.

5. The transfer method according to claim 4, further comprising:

a mask layer curing process, in which the mask layer is cured so that an adhesive strength between the transfer binder layer and the mask layer is stronger than an adhesive strength between the transferred medium and the mask layer.

6. The transfer method according to claim 4, wherein the mask layer is formed of an ink including an ultraviolet curing type resin, and in the sublimation ink layer forming process and the mask layer forming process, the mask layer is formed while forming the sublimation ink layer by an inkjet recording apparatus.

7. The transfer method according to claim 4, wherein after the sublimation ink layer and the mask layer are attached by pressure to the transferred medium in the transfer process, the sublimation ink layer and the transfer binder layer are heated to permeate the sublimation ink into the transfer binder layer.

8. The transfer film according to claim 1, wherein the transfer binder layer is structured of material which causes a sublimation dye to diffuse and develop color when the sublimation dye contained in the sublimation ink sublimes by applying heat.

9. The transfer method according to claim 4, wherein the transfer binder layer is structured of material which causes a sublimation dye to diffuse and develop color when the sublimation dye contained in the sublimation ink sublimes by applying heat.

* * * * *